US009631871B2

(12) United States Patent
Contet et al.

(10) Patent No.: US 9,631,871 B2
(45) Date of Patent: Apr. 25, 2017

(54) RADIATOR MODULE

(75) Inventors: Arnaud Contet, Solvesborg (SE); Kristian Akesson, Bromolla (SE); Jean-Baptiste Leydet, Norrkoping (SE)

(73) Assignee: TitanX Engine Cooling Holding AB, Sölvesborg (SE)

( * ) Notice: Subject to any disclaimer, the term of this patent is extended or adjusted under 35 U.S.C. 154(b) by 1244 days.

(21) Appl. No.: 13/001,692

(22) PCT Filed: Jun. 29, 2009

(86) PCT No.: PCT/SE2009/050827

§ 371 (c)(1),
(2), (4) Date: Dec. 28, 2010

(87) PCT Pub. No.: WO2010/002343

PCT Pub. Date: Jan. 7, 2010

(65) Prior Publication Data

US 2011/0108252 A1 May 12, 2011

(30) Foreign Application Priority Data

Jul. 1, 2008 (SE) ..... 0801555

(51) Int. Cl.
*F28F 9/26* (2006.01)
*F28F 9/02* (2006.01)
(Continued)

(52) U.S. Cl.
CPC ..... *F28D 1/0443* (2013.01); *F28D 1/0417* (2013.01); *F28F 9/0224* (2013.01); *F28F 9/0278* (2013.01); *F28F 9/262* (2013.01)

(58) Field of Classification Search
CPC .... F28D 1/0417; F28D 1/0443; F28F 9/0224; F28F 9/0278; F28F 9/262
(Continued)

(56) References Cited

U.S. PATENT DOCUMENTS 1,899,629 A * 2/1933 Morse ..... 165/134.1
2,915,294 A * 12/1959 Christensen ..... 165/174
(Continued)

FOREIGN PATENT DOCUMENTS

WO 2004/027232 A1 4/2004
WO 2006/083451 A2 8/2006
(Continued)

OTHER PUBLICATIONS

International Search Report: PCT/SE2009/050827.

*Primary Examiner* — Ryan J Walters
*Assistant Examiner* — Jason Thompson
(74) *Attorney, Agent, or Firm* — Ladas & Parry LLP

(57) ABSTRACT

A radiator module having a coolant inlet duct and a coolant outlet duct and two radiators. The first radiator has a first core connected between a first inlet tank and a first outlet tank and the second radiator has a second core connected between a second inlet tank and a second outlet tank. The coolant inlet duct is connected to a coolant inlet of the first inlet tank and the coolant outlet duct is connected to a coolant outlet of the first outlet tank. According to the invention a coolant outlet of the first inlet tank is connected to a coolant inlet of the second inlet tank, a coolant inlet of the first outlet tank is connected to a coolant outlet of the second outlet tank and a flow restrictor is provided in one of the first tanks in front of the first core, such that the coolant flow between the core and said one of the first tanks is restricted.

16 Claims, 4 Drawing Sheets

(51) Int. Cl.
*F28D 7/02* (2006.01)
*F28D 1/04* (2006.01)

(58) Field of Classification Search
USPC ..... 165/158, 173, 148, 144
See application file for complete search history.

(56) References Cited

U.S. PATENT DOCUMENTS

| | | | | | |
|---|---|---|---|---|---|
| 3,004,626 | A * | 10/1961 | Brinen | 96/204 | |
| 4,106,558 | A * | 8/1978 | Neveux | 165/109.1 | |
| 4,932,223 | A * | 6/1990 | Paul et al. | 62/354 | |
| 5,152,339 | A * | 10/1992 | Calleson | 165/173 | |
| 5,415,223 | A * | 5/1995 | Reavis et al. | 165/96 | |
| 5,947,196 | A * | 9/1999 | Halm et al. | 165/173 | |
| 6,484,797 | B2 * | 11/2002 | Saito | F28F 9/0273 | 165/153 |
| 6,571,866 | B2 * | 6/2003 | AbdulNour et al. | 165/153 | |
| 6,619,380 | B1 * | 9/2003 | Hartman et al. | 165/173 | |
| 6,827,139 | B2 * | 12/2004 | Kawakubo et al. | 165/173 | |
| 2003/0010483 | A1 * | 1/2003 | Ikezaki | F28F 3/083 | 165/174 |
| 2008/0000627 | A1 * | 1/2008 | Noguchi | F28D 1/05366 | 165/173 |

FOREIGN PATENT DOCUMENTS

| | | | | |
|---|---|---|---|---|
| WO | WO 2006083451 | A2 * | 8/2006 | F25B 39/028 |
| WO | 2008/048505 | A2 | 4/2008 | |

* cited by examiner

Prior Art

RADIATOR MODULE

TECHNICAL FIELD

The present invention concerns a radiator module comprising a coolant inlet duct and a coolant outlet duct and two radiators, the first radiator having a first core connected between a first inlet tank and a first outlet tank and the second radiator having a second core connected between a second inlet tank and a second outlet tank, wherein said coolant inlet duct is connected to a coolant inlet of the first inlet tank and said coolant outlet duct is connected to a coolant outlet of the first outlet tank.

PRIOR ART

A prior art radiator module 1 according to the preamble is shown in FIG. 6 in an elevational view. It comprises a first or lower radiator 2 having a first or lower core 3 connected between a first or lower inlet tank 4 and a first or lower outlet tank 5 and a second or upper radiator 6 having a second or upper core 7 connected between a second or upper inlet tank 8 and a second or upper outlet tank 9. There is a coolant inlet duct 10 comprising a steel manifold 11, which is connected to a coolant inlet 12 of the first or lower inlet tank 4 as well as to a coolant inlet 13 of the second or upper inlet tank 8. There also is a coolant outlet duct 14 comprising a steel manifold 15, which is connected to a coolant outlet 16 of the first or lower outlet tank 5 as well as to a coolant outlet 17 of the second or upper outlet tank 9. Thus, both radiators 2, 6 are able to cooperate, giving a radiator module 1 made up from two radiators 2, 6 of identical size twice the capacity of a single radiator 2, 6 of the size in question.

The advantage of such a radiator module 1 is that it renders use of standard sized radiators 2, 6 possible in cases where a larger cooling capacity is required, which of course involves advantageous use of standard production equipment for said radiators 2, 6 as well.

It is obvious that the purpose of the manifolds 11, 15 is to evenly distribute the flow of coolant between said upper and lower radiator 2, 6 in order to achieve maximum efficiency for both of them. However, it is obvious too that the manifolds 11, 15 add some weight and size to the radiator module 1 as well as production costs. Therefore it would be of great benefit if one could eliminate said manifolds 11, 15 and interconnect the radiators 2, 6 in a more convenient way.

An obvious way to do so would be to connect the inlet tank 4 of the first or lower radiator 2 directly to the inlet tank 8 of the second or upper radiator 6 and to lead coolant into both tanks 4, 8 through a coolant inlet provided in the inlet tank 4 of the first or lower radiator 2, and to connect the outlet tank 5 of the first or lower radiator 2 directly to the outlet tank 9 of the second or upper radiator 6 and to lead coolant out of both tanks 5, 9 through a coolant outlet provided in the outlet tank 5 of the first or lower radiator 2. However, in practice it shows that a solution of that kind leads to an uneven distribution of coolant through the first or lower and the second or upper radiator 2, 6 of the radiator module 1 with a considerably larger flow of coolant through the first or lower radiator 2 than through the second or upper radiator 6.

There is no doubt that this is due to placement of one radiator in series with the other, requiring a somewhat higher pressure to reach the second one of both.

OBJECT OF THE INVENTION

In view of the drawbacks of the previous design and the difficulties encountered when trying to eliminate these drawbacks the obvious way, the object of the invention is to accomplish a radiator module according to the preamble void of manifolds and with interconnected inlet tanks and interconnected outlet tanks and yet showing a favorable coolant flow distribution.

SUMMARY OF THE INVENTION

According to the invention this object is achieved in a radiator module according to the preamble by means of a coolant outlet of the first inlet tank being connected to a coolant inlet of the second inlet tank, by a coolant inlet of the first outlet tank being connected to a coolant outlet of the second outlet tank and by a flow restrictor being provided in one of the first tanks in front of the first core, such that the coolant flow between the first core and said one of the first tanks is restricted. Thanks to this solution it is possible to directly interconnect two radiators tank to tank, thus creating a radiator module, and to provide a radiator module inlet duct and a radiator module outlet duct on the first radiator only and yet to achieve an even flow distribution between the two radiators of said module.

According to a preferred embodiment said flow restrictor comprises a plate, which fits inside said one of the first tanks in front of the first core and provides flow restriction by means of perforations. A flow restrictor of that kind is easy to accomplish either of sheet metal or plastics.

Preferably the perforations of said plate have a perforation area pa compared to a throughput area ta of the first core within an interval of 0.2 and 0.5, preferably within an interval of 0.3 and 0.4, and most preferably of 0.35. Given the usual pressures and flow volumes of radiator modules, it turns out that a perforation area as defined provides a comparable flow of coolant through both radiators.

It is preferred to arrange said plate by snap fitting it inside of said one of the first tanks by means bosses before assembly of said one of the first tanks with said first core. It is obvious that snap fitting is easy to accomplish and that handling of the tank during assembly with the plate snap fitted inside is facilitated considerably.

Further it is preferred to secure said plate within said one of the first tanks by means of a hook, which protrudes from an end part of said plate and is inserted in an inlet or outlet of said one of the first tanks. The hook primarily serves to keep the plate in place when the radiator module is in use but does also support said bosses in holding the plate during assembly.

Preferably a mid part of said plate is arranged to be kept apart from the first core by means of spacers, which protrude from said mid part and abut against a header plate of the first core. Thus, said spacers too serve to keep the plate in place when the radiator module is in use as well as during assembly.

According to a preferred embodiment of the invention all tanks are of identical design with opposing ports used as an inlet and/or outlet or plugged by means of a cap. It is obvious to the person skilled in the art that tanks of identical design help to reduce manufacturing costs and improve logistics.

Preferably, with tanks of identical design, one of said ports of each tank comprises a hose flange, wherein the hose flanges of said inlet tanks and the hose flanges of said outlet tanks are facing each other and are interconnected by means of hose pieces. Clearly, junctions of that kind between the tanks involved are both simple to accomplish and furthermore vibration proof, which is further improved by forming said hose flanges as integral parts of said tanks.

With tanks of identical design, preferably one of said ports of each tank comprises a mounting flange on which is mountable a coolant inlet or outlet duct or a cap. Thus, the tank involved is easy to adapt to its task in the radiator module ready for use.

In order to eliminate the risk of incorrect assembly when tanks of identical design are used said one of the first tanks comprising the perforated plate, which is not visible after assembly of said one of the first tanks with the first core, has a color marking separating it from the remaining tanks. Preferably, when all tanks are made of plastics, said color marking comprises use of a differently colored resin for said one of the first tanks.

It shows that for optimum flow conditions it is preferred to let said one of the first tanks be the outlet tank.

Finally, according to a preferred embodiment the two radiators are mounted on top of each other, the first radiator being the lower one and the second radiator being the upper one.

SHORT DESCRIPTION OF THE DRAWINGS

In the drawings a preferred embodiment of the radiator module according to the invention is shown as well as a view of a prior art solution, wherein.

DESCRIPTION OF A PREFERRED EMBODIMENT

Figure 1:
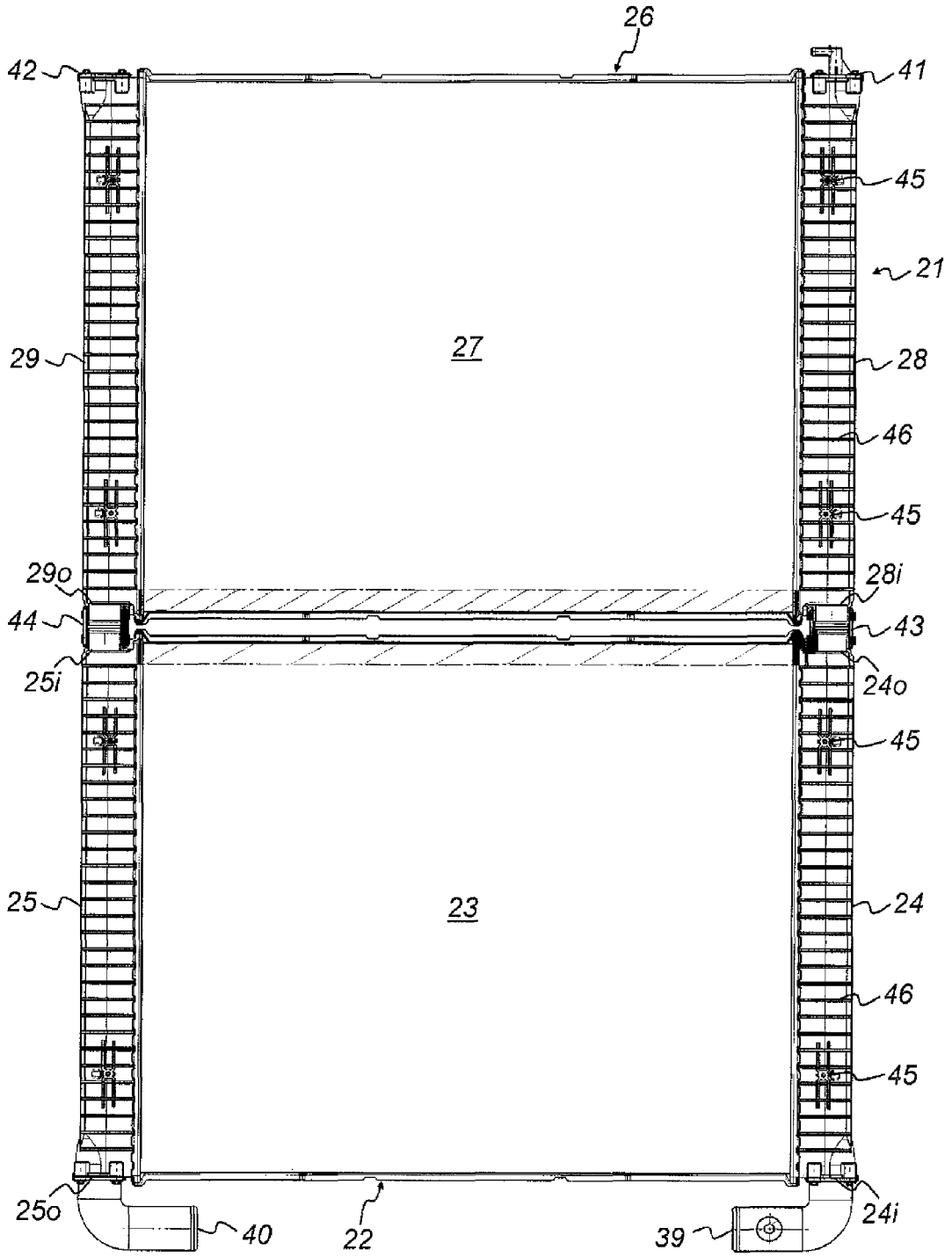
FIG. 1 is an elevational view of a radiator module according to the invention.

A prior art radiator module 1 has been described in detail hereinbefore. The radiator module 21 according to the preferred embodiment of the invention has several features in common with it. Thus said embodiment comprises a first or lower radiator 22, having a first or lower core 23 connected between a first or lower inlet tank 24 and a first or lower outlet tank 25, and a second or upper radiator 26, having a second or upper core 27 connected between a second or upper inlet tank 28 and a second or upper outlet tank 29. Both radiators 22, 23 are of identical size and have identical cores 23, 27 and almost identical coolant tanks 24, 25, 28, 29, although the orientation of said tanks differs in a way described later on, where only placement of the radiators 22, 26 on top of each other is considered.

Differing from prior art the 1 radiator module 21 according to the invention does not comprise any manifolds. Instead it comprises a coolant inlet duct 39, which is connected directly to a coolant inlet 24*i* of the lower inlet tank 24, and a coolant outlet duct 40, which is connected directly to a coolant outlet 25*o* of the lower outlet tank 25. Further it comprises a coolant outlet 24*o* of the lower inlet tank 24, which is connected to a coolant inlet 28*i* of the upper inlet tank 28, and a coolant inlet 25*i* of the lower outlet tank 25, which is connected to a coolant outlet 290 of the upper outlet tank 29.

Figure 2:
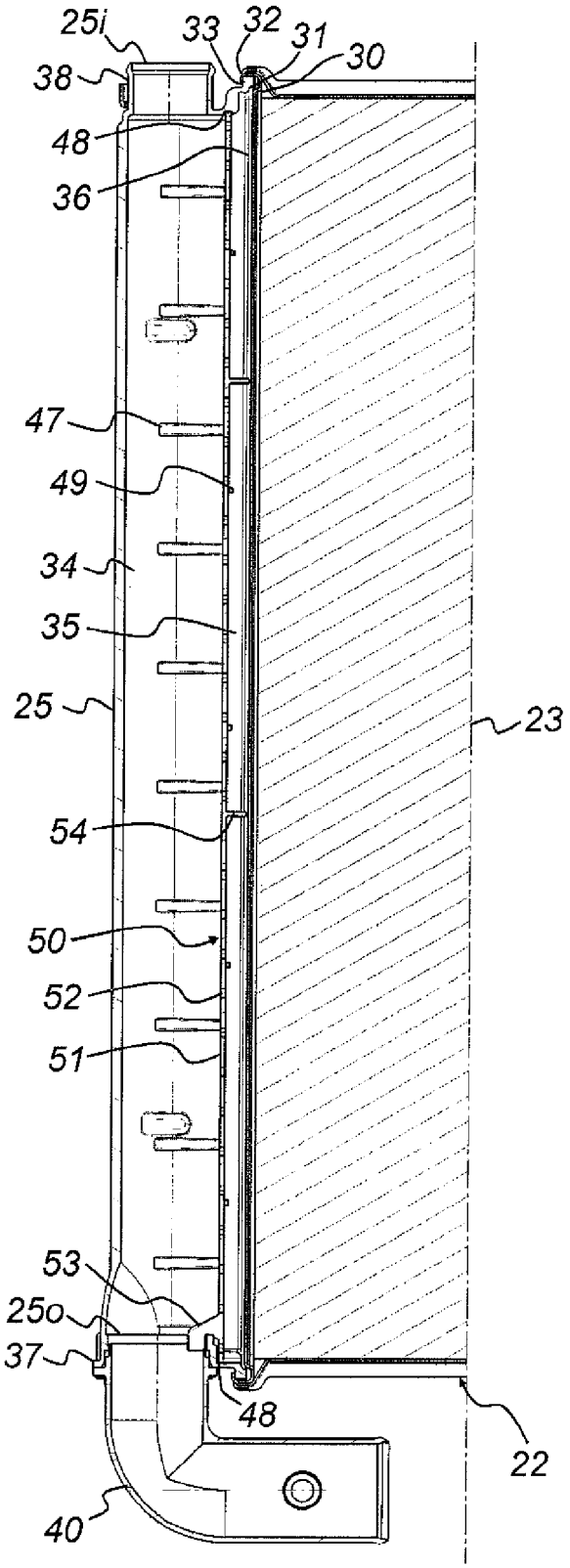
FIG. 2 is a sectional view of an outlet side of the lower radiator in FIG. 1.
Figure 3:
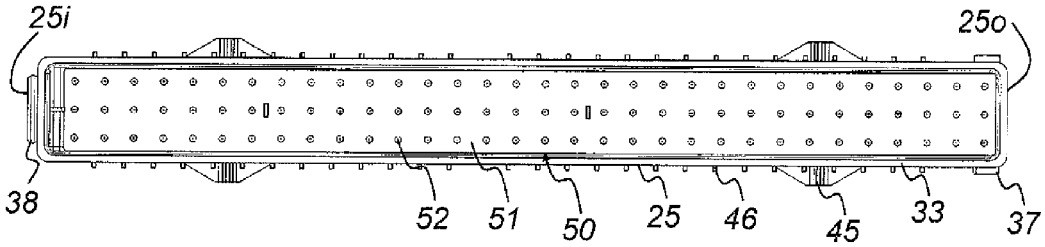
FIG. 3 is an inside view of an outlet tank of the lower radiator in FIG. 1.
Figure 4:
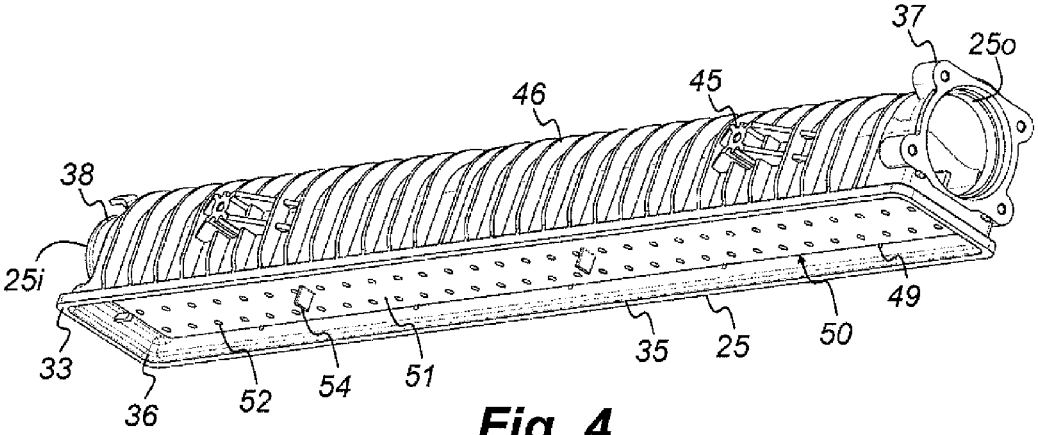
FIG. 4 is a perspective view of the outlet tank in FIG. 3.
Figure 5:
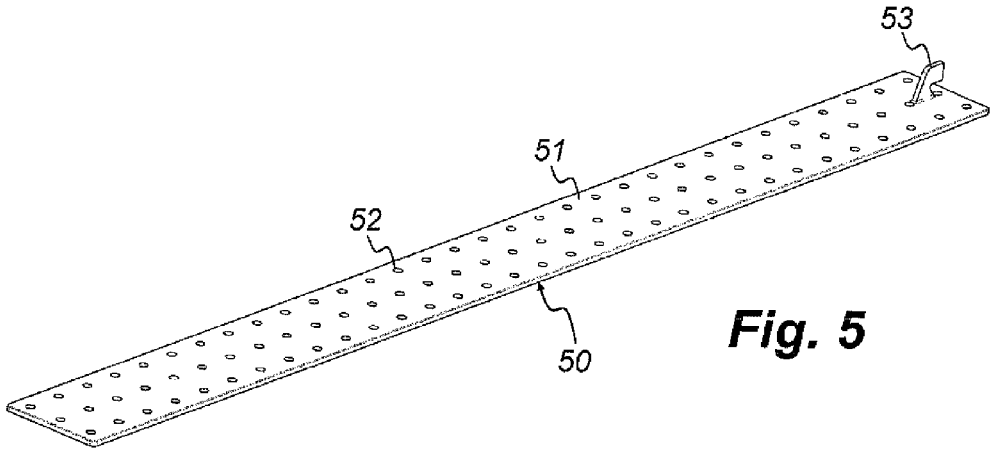
FIG. 5 is a perspective view of a perforated flow restrictor plate of the outlet tank in FIGS. 3 and 4.
Figure 6:
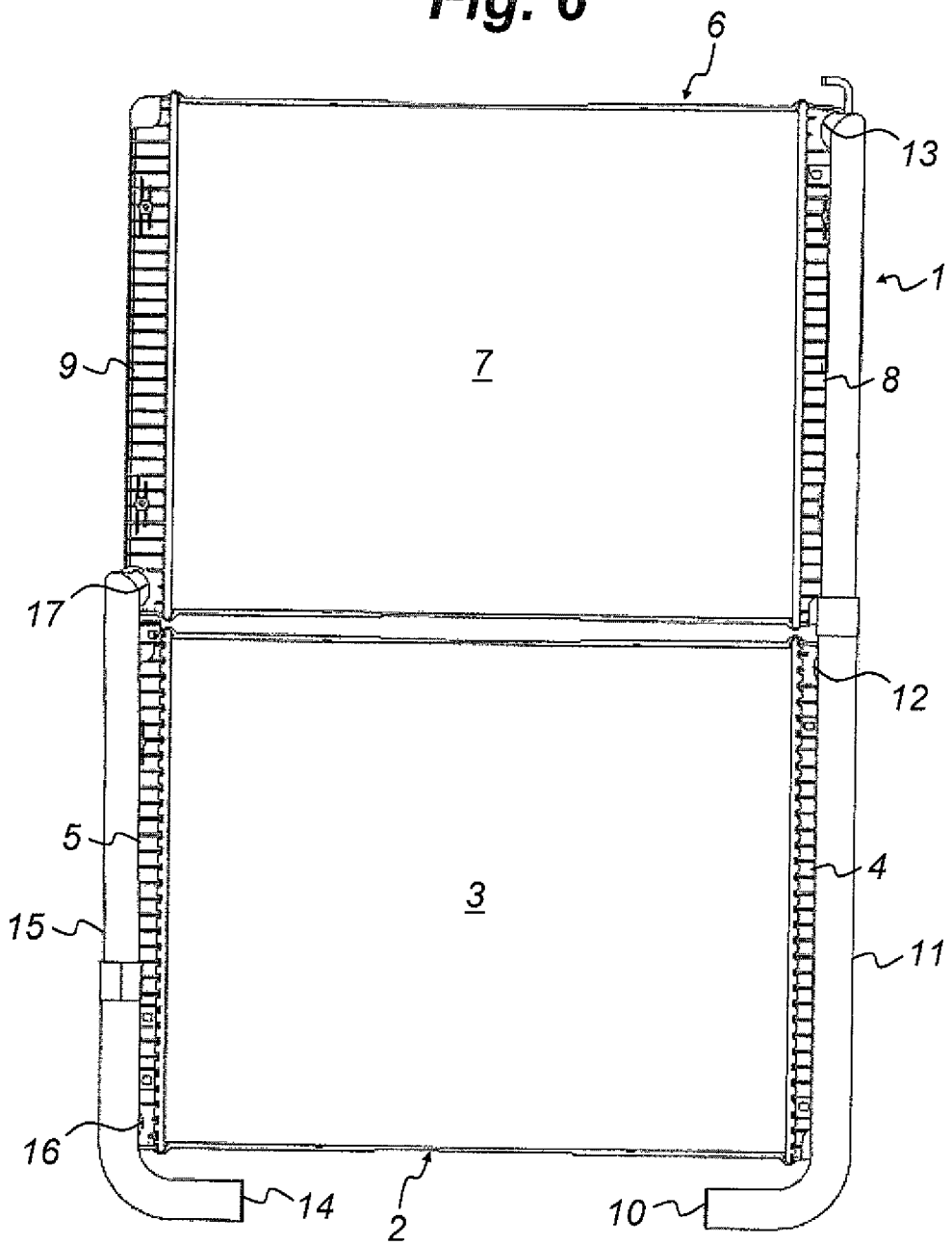
FIG. 6 is an elevational view of the prior art radiator module described in the foregoing.

Each core 23, 27 comprises a number of coolant tubes (not shown) debouching into apertured header plates, one of which, designated 30, is shown in detail in FIG. 2 for the outlet tank 25 of the lower radiator 22. The arrangement for the remaining header plates is exactly the same. The header plate 30 is made of sheet metal and is tightly connected to its tank 25 by means of a gasket 31 and of a circumferential edge part 32 comprising tabs, which are bent over a corresponding rim 33 of said tank 25 in a crimping process.

In the preferred embodiment shown all four coolant tanks 24, 25, 28, 29 are made of reinforced plastics material. They have a number of common features which again are described in detail for all four tanks with reference to the sectional view in FIG. 2 only, where the outlet coolant tank 25 of the lower radiator is shown. Coolant tank 25 comprises a molded box-shaped housing 34 being of a longitudinal shape and having a rectangular header plate opening 35 along one of its long sides. The header plate opening 35 is delineated by the rim 33 mentioned in the foregoing, which at the header plate opening 35 circumferentially runs around the outside of the tank 25. On the inside of the header plate opening 35 there is a circumferential seat 36 for said gasket 31. In the short sides of the tank 25 there too is one opening each. The first one of these is formed by a mounting flange 37, which on tank 25 is located at the bottom, and the second one thereof is formed by a hose flange 38, which on tank 25 is located at the top. The mounting and hose flange location at the bottom and top of the tank 25 is a corresponding one on the inlet coolant tank 24 of the lower radiator 22, whereas it is an opposite one on the inlet and outlet tanks 28, 29 of the upper radiator 26, i.e. at the upper radiators there are hose flanges at the bottom and mounting flanges at the top (c.f. FIG. 1).

As can be seen in FIG. 1, the bottom mounting flanges are used to attach said coolant inlet duct 39 on the bottom inlet tank 24 and said coolant outlet duct 40 on the bottom outlet tank 25. The top mounting flanges are, as shown, used to attach a vent cap 41 on the top inlet tank 28 and a sealing cap 42 on the top outlet tank 29. The hose flanges of the inlet tanks 24, 28 are facing each other and are interconnected by means of a hose piece 43, which goes for the hose flanges of the outlet tanks 25, 29 as well, although their hose piece is designated 44. It is obvious that there has to be some means for securing of the hose pieces 43, 44 on the hose flanges in a fluid tight matter, e.g. by means of a hose clamp, but this is not shown in detail. Further it is obvious to provide on all four tanks 24, 25, 28, 29 some sort of outside attachment means 45, in order to facilitate mounting of the radiators 22, 26 of the radiator module 21, and fins 46, in order to improve strength.

In the following the essence of the invention is described in connection with FIGS. 2 to 5. As can be seen in FIG. 2, along long sides of the outlet coolant tank 25 of the lower radiator 22 there are a number of internal ribs 47, which extend towards the header plate opening 35. Further there are shoulders 48 inside the short sides of said tank 25. Together the ribs 47 and shoulders 48 define an abutment plane, which is used in the outlet coolant tank 25 alone to seat a flow restrictor 50. The flow restrictor 50 comprises a rectangular plate 51, preferably of plastics, which fits inside the tank 25 and, when it abuts the ribs 47, is spaced apart from the facing header plate 30 a distance big enough to allow cross flow of coolant between the two. Opposite to the ribs 47 there are a number of bosses 49, one at each second interval between adjoining ribs 47 and shoulders 48. Said bosses 49 are used for snap fitment of the plate 51. Thus, it is obvious that they are spaced far enough from the abutment plane to accommodate the plate 51 and that they are slightly tapered in order to facilitate the snap fitment action.

The plate 51 of the flow restrictor 50 comprises a large number of perforations 52 evenly distributed over the entire plate area. The total area pa of these perforations 52 is in order to provide flow restriction less than a throughput area ta for coolant flow through the lower core 23 as defined by a header plate 30 or the coolant tubes of said core 23. The relationship between the perforation area pa and the throughput area ta lies preferably within an interval of 0.2 and 0.5, more preferably within an interval of 0.3 and 0.4, and most preferably at 0.35 given the arrangement shown in FIG. 1. It is obvious that the shape of the perforations 52 is of minor importance but that their individual size and placement has to be chosen in a way that does not favor some coolant tubes of the lower radiator core 23 and discriminate others.

In order to improve production friendliness and durability, in the preferred embodiment of the invention there are some other features to the flow restrictor plate 51. The first one mainly concerns production and comprises of a hook 53, which is provided on said plate 51 on the side intended to face away from the lower core 23. The hook 53 protrudes from an end part of said plate 51 and is adapted to be inserted into the bottom mounting flange 37 preventing the plate 51 from dropping out of position during production. The second one concerns durability and comprises of spacers 54, which are provided on said plate 51 on the side intended to face the lower core 23. The spacers 54 protrude from a mid part of said plate 51 and are adapted to abut against the outlet header plate 30 of the lower core 23 thus safely keeping said plate 51 on the intended distance from the lower core 23 even under severe running conditions.

According to the preferred embodiment of the invention, there is an external individual feature to one of the four identical coolant tanks 24, 25, 28, 29, namely tank 25 with the flow restrictor 50 inside of it, said feature distinguishing it from the other tanks in a production friendly way without requiring production tooling differing from the one used for the other tanks 24, 28, 29. Said feature comprises use of a differently colored resin when molding said tank 25, which, when otherwise identical radiators 22, 26 are used, guarantees first that the right radiator is placed at the bottom of the radiator module 21 and second that the lower radiator 22 as such is turned in the way it is intended to be with tank 25 comprising the flow restrictor 50 on the outlet side.

Although the preferred embodiment of the invention comprises a flow restrictor plate 51 in the outlet tank 25 of the lower radiator 22, it is possible to provide said plate 51 in the inlet tank 24 instead. However, the preferred placement provides for safer working conditions, inter alia because the flow restrictor plate 51 is biased into its seating position by the coolant flow through the lower radiator 23.

The invention claimed is:

1. A radiator module comprising a coolant inlet duct and a coolant outlet duct and two radiators, the first radiator having a first core connected between a first inlet tank and a first outlet tank and the second radiator having a second core connected between a second inlet tank and a second outlet tank, wherein said coolant inlet duct of the radiator module is connected to a coolant inlet of the first inlet tank and said coolant outlet duct of the radiator module is connected to a coolant outlet of the first outlet tank, wherein each of the tanks comprise a box shaped housing with a first rim, in which a header plate of a respective core fits, wherein a coolant outlet of the first inlet tank is connected to a coolant inlet of the second inlet tank, wherein a coolant inlet of the first outlet tank is connected to a coolant outlet of the second outlet tank, wherein a flow restrictor plate is fitted in one of the first tanks adjacent to a header plate of the first core within a second rim at a location below an axis defined the coolant inlet and the coolant outlet, and wherein said flow restrictor plate dividing said one of the first tanks into a transit portion where coolant flow between the coolant inlet and the coolant outlet of said one of the first tanks is unimpeded by the flow restrictor plate and an obstruction portion where coolant flow between the first core and said transit portion is impeded by the flow restrictor plate.

2. The radiator module according to claim 1, wherein said flow restrictor plate provides flow restriction by means of perforations.

3. The radiator module according to claim 2, wherein said perforations have a perforation area pa compared to a throughput area ta of the first core within an interval of 0.2 and 0.5.

4. The radiator module according to claim 3, wherein said perforations have a perforation area pa compared to a throughput area ta of the first core within an interval of 0.3 and 0.4.

5. The radiator module according to claim 3, wherein said perforations have a perforation area pa compared to a throughput area ta of the first core of 0.35.

6. The radiator module according to claim 2, wherein a mid part of said flow restrictor plate is kept apart from the first core by means of spacers, which protrude from said mid part and abut against the header plate of the first core.

7. The radiator module according to claim 1, wherein all tanks are of identical design with opposing ports used as an inlet and/or outlet or plugged by means of a cap.

8. The radiator module according to claim 7, wherein one of said ports of each tank comprises a hose flange, and wherein the hose flanges of said inlet tanks and the hose flanges of said outlet tanks are facing each other and are interconnected by means of hose pieces.

9. The radiator module according to claim 8, wherein said hose flanges form an integral part of said tanks.

10. The radiator module according to claim 7, wherein one of said ports of each tank comprises a mounting flange on which is mountable a coolant inlet or outlet duct or a cap.

11. The radiator module according to claim 1, wherein said one of the first tanks comprising the flow restrictor plate has a color marking separating it from the remaining tanks.

12. The radiator module according to claim 11, wherein all tanks are made of plastics and said color marking comprises use of a differently colored resin for said one of the first tanks.

13. The radiator module according to claim 1, wherein said one of the first tanks is the outlet tank.

14. The radiator module according to claim 1, wherein the two radiators are mounted on top of each other, said first radiator being the lower one and said second radiator being the upper one.

15. The radiator module according to claim 1, wherein said flow restrictor plate is seated inside said one of the first tanks by means of snap fit bosses.

16. The radiator module according to claim 1, wherein said flow restrictor plate is secured within said one of the first tanks by means of a hook, which protrudes from an end part of said flow restrictor plate and is inserted in an inlet or outlet of said one of the first tanks.

* * * * *